US009863103B2

(12) United States Patent
Osberg et al.

(10) Patent No.: US 9,863,103 B2
(45) Date of Patent: Jan. 9, 2018

(54) MODULAR BRIDGE DECK SYSTEM CONSISTING OF HOLLOW EXTRUDED ALUMINUM ELEMENTS

(71) Applicant: AlumaBridge, LLC, Ann Arbor, MI (US)

(72) Inventors: Greg Osberg, Dexter, MI (US); George Patton, Safety Harbor, FL (US)

(73) Assignee: ALUMABRIDGE, LLC, Ann Arbor, MI (US)

( * ) Notice: Subject to any disclaimer, the term of this patent is extended or adjusted under 35 U.S.C. 154(b) by 73 days.

(21) Appl. No.: 15/051,866

(22) Filed: Feb. 24, 2016

(65) Prior Publication Data

US 2016/0244921 A1 Aug. 25, 2016

Related U.S. Application Data

(60) Provisional application No. 62/120,001, filed on Feb. 24, 2015.

(51) Int. Cl.
*E01D 19/12* (2006.01)
*E01D 101/34* (2006.01)

(52) U.S. Cl.
CPC ..... *E01D 19/125* (2013.01); *E01D 19/12* (2013.01); *E01D 2101/34* (2013.01)

(58) Field of Classification Search
CPC .... E01D 19/12; E01D 19/125; E01D 2101/34
USPC ..... 14/31–36, 73, 73.1, 74, 74.5, 77.1; 52/592.1
See application file for complete search history.

(56) References Cited

U.S. PATENT DOCUMENTS 1,991,154 A * 2/1935 Irving ..... E01D 15/06 14/73
3,984,961 A * 10/1976 Chieger ..... B65D 90/026 404/35
5,033,147 A * 7/1991 Svensson ..... E01D 19/125 14/73

(Continued)

FOREIGN PATENT DOCUMENTS

EP 0893189 A2 1/1999
WO 2004029364 A1 4/2004

OTHER PUBLICATIONS

"Market Study for Aluminium Use in Roadway Bridges", Viami International Inc. and The Technology Strategies Group, May 2013, 29 pages.

(Continued)

*Primary Examiner* — Raymond W Addie
(74) *Attorney, Agent, or Firm* — Robert L. Wolter; Beusse, Wolter, Sanks & Maire PLLC

(57) ABSTRACT

A modular bridge deck system supported on a plurality of cooperating girders and the deck system that comprises a plurality of deck panels secured together to form a modular bridge deck. Each deck panel is preferably formed by longitudinally shop friction-stir welding a plurality of elongated, multi-void, extruded aluminum structural elements. A top surface of each respective deck panel and the longitudinal shop-welding form a substantially continuous top surface of the modular bridge deck. In addition, the modular bridge deck has a depth and weight that is substantially equal to a weight of a steel open-grid deck of a moveable bridge or fixed span bridge to be replaced by the modular bridge deck system.

5 Claims, 7 Drawing Sheets

(56) References Cited

U.S. PATENT DOCUMENTS

| | | | | |
|---|---|---|---|---|
| 5,651,154 | A | 7/1997 | Ahlskog et al. | |
| 5,810,507 | A | 9/1998 | Ahlskog et al. | |
| 5,836,029 | A | 11/1998 | Garber et al. | |
| 5,901,396 | A | 5/1999 | Ahlskog et al. | |
| 6,199,745 | B1 | 3/2001 | Campbell et al. | |
| 7,178,303 | B2 * | 2/2007 | Aota | B23K 20/122 228/112.1 |
| 2014/0119814 | A1 * | 5/2014 | Osikowicz | B23K 20/1255 403/270 |
| 2017/0167090 | A1 * | 6/2017 | Allen | E01D 19/125 |

OTHER PUBLICATIONS

"Bascule Bridge Lightweight Solid Deck Retrofit Research Project Deck Alternative Screening Report", Prepared by URS Corporation for Florida Department of Transportation, May 14, 2012, 116 pages.
"Bascule Bridge Lightweight Solid Deck Retrofit Research Project" PowerPoint presentation prepared by URS Corporation and presented at Aluminum Orthotropic Deck Research Update Meeting in Tallahassee, Florida, Feb. 19, 2014, 102 pages.
"Declaration of Greg Osberg", Jun. 6, 2016, 3 pages.
International Search Report and Written Opinion for PCT/US2016/019224; dated Jul. 26, 2016; 15 pages.

* cited by examiner

MODULAR BRIDGE DECK SYSTEM CONSISTING OF HOLLOW EXTRUDED ALUMINUM ELEMENTS

CROSS-REFERENCE TO RELATED APPLICATIONS

This application claims the benefit of U.S. Provisional Application No. 62/120,001 filed Feb. 24, 2015, and incorporated herein by reference in its entirety.

FIELD OF THE INVENTION

This invention relates to a bridge deck system and, more particularly, to a bridge deck made from modular bridge deck panels formed to selective shapes and sizes by shop-welding hollow extruded aluminum structural elements that are shop-bolted or field-bolted to supporting transverse stringers that are field-connected to a bridge superstructure. More particularly, aspects of the invention pertain to such modular bridge deck panels with a solid top surface and of a depth and weight that may be used to replace steel open-grid bridge decks of moveable bridges, and other types such as fixed span or non-moveable with limited modifications to the bridge.

BACKGROUND OF THE INVENTION

As bridges age, they deteriorate due to traffic and corrosion or are subjected to loads exceeding those for which they were originally designed. This creates a need to repair or modify existing bridges. Also, growing traffic demands new bridges. The bridge's foundation supports the bridge's main structural members called the superstructure. The superstructure, in turn, supports the bridge deck upon which traffic moves. As the foundation and superstructure deteriorate, the load that the bridge can support is reduced. Reducing the bridge's deck weight reclaims traffic load capacity lost to that deterioration. The deck and superstructure of moveable bridges are periodically lifted to permit the passage of ships in the waterway spanned by the bridge. For such bridges, lightweight bridge decks that are weight neutral to steel open grid decks are needed.

Many moveable bridges use steel grating (a.k.a. steel open-grid deck or steel open-grid roadway flooring) for the bridge deck in an effort to reduce weight. Grating, however, has many disadvantages. It provides little skid resistance for vehicles, especially when worn. Drivers perceive a lack of control of their vehicles on the grating surface. Traffic is noisy when traversing grating. The grating and welds attaching the grating to the bridge superstructure are especially prone to fatigue failure. The openings in the grating permit moisture and debris to collect on the surfaces of the superstructure steel members, which promotes corrosion. Finally, grating permits liquids from vehicles to pass through the grating and below the bridge, polluting waterways.

In 2012, the Florida Department of Transportation (FDOT) published a report entitled *Bascule Bridge Lightweight Solid Deck Retrofit Research Report—Deck Alternative Screening Report*. (prepared by URS now AECOM) (hereinafter referred to as the "FDOT Report). The FDOT Report investigated and evaluated alternative deck systems that may be used to replace steel open-grid bridge decks for bascule bridges. To that end the report evaluated an aluminum orthotropic deck system. More specifically, the FDOT Report evaluated a friction-stir welded 5-inch aluminum orthotropic deck similar to the 8-inch deep Sapa R-Section Deck, but fabricated specifically to replace a 5-inch steel open-grid deck.

The alternative 5-inch deep aluminum orthotropic deck extrusion proposed in the FDOT is illustrated in FIG. 1. Again, the extrusion profile is similar to the 8-inch Sapa R-section deck extruded by Sapa Extrusions, Inc. As shown, the extrusion 200 includes a top flange 202, a bottom flange 204, inclined plates 206, 208 and a vertical plate 210 disposed between the inclined plates 206, 208 forming voids 212, 214 having a cross-sectional inverted right triangle configuration.

While the FDOT proposed the aluminum extrusion 200 of FIG. 1 as an option for a 5-inch aluminum orthotropic bridge deck panel, the inventors of the subject invention are not aware that such a bridge deck panel has been fabricated. However, the assignee, AlumaBridge, LLC, conducted fabrication trials with both the 5-inch and 8-inch deep orthotropic aluminum bridge deck panels having the extrusion profile as that of FIG. 1. The aluminum extrusions were longitudinally shop welded to form the bridge deck panels using a two-sided friction-stir welding with self-reacting pin tools. It was found that the fabrication of a bridge deck panels and a bridge deck using the extruded aluminum elements of FIG. 1 and friction-stir welding, was cost prohibitive.

Again in reference to FIG. 1, the respective ends 202A, 202B of the top flange 202 are relatively close to respective radii 216A, 216B between inclined plates 206, 208 and flange ends 202A, 202B. The top flange ends 202A, 202B were about 0.850 inches thick, and the bottom flanges 204 were about 0.370 inches thick. The lower pin tool of the friction-stir welding system tended to bounce during welding because the radii 216A, 216B were too close to the ends 202A, 202B creating difficulties in welding. More specifically, when welding top flanges of adjacent extruded elements the pin tools bounced because the pin tools contacted the radii 216A, 216B during welding. Moreover, the top flange 202 was thicker than the bottom flange 204 so the top flanges 202 of adjacent elements took much longer to weld so the top and bottom flanges 202, 204 of adjacent extruded elements could not be simultaneously welded. It was also discovered that simultaneously welding flanges with dissimilar thicknesses makes it difficult to control weld shrinkage and keep the finished bridge deck panel flat. Weld shrinkage is caused by heat generated during the friction-stir welding process. This required either the top flanges 202 or bottom flanges 204 to be welded first, and the extruded elements had to be flipped and rotated to start welding top flanges 202 or bottom flanges 204, depending on which were welded first.

Needless to say the process was not only time consuming, but potentially hazardous to laborers that fabricated the deck panel. The inventors of the subject invention have developed a deck panel and extruded aluminum elements that are much more cost effective in assemble. More specifically, the aluminum extruded elements have a profile that allows the extruded elements to be friction-stir welded much more efficiently and cost effectively.

SUMMARY OF THE INVENTION

A modular bridge deck system supported on a plurality of cooperating girders and the deck system that comprises a plurality of deck panels secured together to form a modular bridge deck. Each deck panel is preferably formed by longitudinally shop friction-stir welding a plurality of elongated, multi-void, extruded aluminum structural elements. A top surface of each respective deck panel and the longitudinal shop-welding form a substantially continuous top surface of the modular bridge deck. In addition, the modular bridge deck has a weight that is substantially equal to a weight of a 5-inch deep steel open-grid bridge deck of a moveable bridge, such as a bascule bridge, or fixed span bridge to be replaced by the modular bridge deck system.

In embodiments, each of the aluminum structural elements is the same length and each deck panel has at least one extruded aluminum structural end element. The structural end element may comprise a top flange longitudinally shop friction-stir welded to a corresponding top flange of an outer extruded aluminum structural element of a deck panel. In addition, the end structural element includes a bottom flange longitudinally shop-welded to a corresponding bottom flange of the outer extruded aluminum structural element of the deck panel, and a vertically disposed web integrally formed with the top flange and bottom flange. The aluminum structural end element, including the top flange, bottom flange and web, has a length that is equal to a length of each aluminum structural element of the deck panel.

BREIF DESCRIPTION OF THE DRAWINGS

DETAILED DESCRIPTION OF THE INVENTION

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained.

Figure 2:
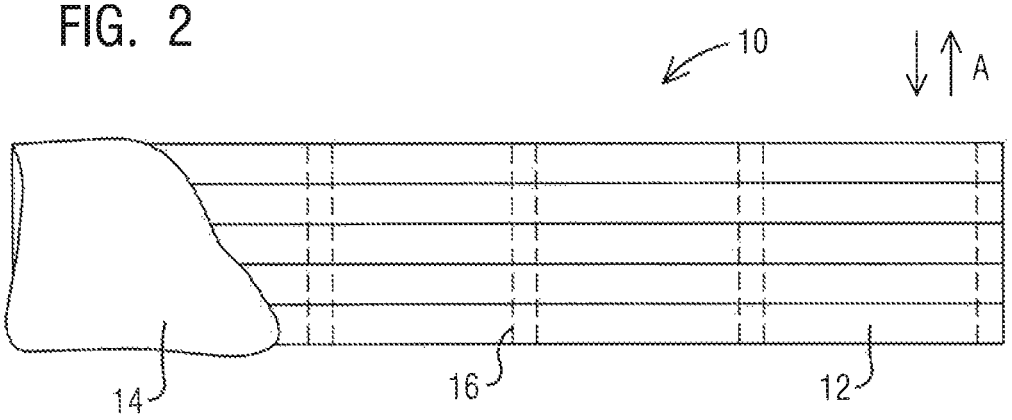
FIG. 2 is a top plan view of a bridge deck panel in accordance with aspects of the invention.

With respect to FIG. 2 a portion of a bridge deck panel 10 includes a plurality of extruded multi-void aluminum structural elements 12, which are preferably friction-stir welded along longitudinal edges thereof. A wearing layer 14 is applied to the top surface of the panel 10 providing skid resistance for vehicles traversing the bridge. Stringer beams 16 are attached to the bottom side of the deck and are oriented transverse to the extrusions 12. More specifically, stringer beams 16 are used to join together and support multiple deck panels 10 to form a bridge deck. The structural elements 12 disposed transverse to a direction of travel as represented by arrows A, while the stringer beams 16 are disposed longitudinally with the direction of travel.

A preferred material for forming the multi-void extruded elements 12 is aluminum alloy 6063 temper 6 or a similar aluminum alloy. Aluminum is light, strong, easily welded by friction-stir methods, corrosion resistant without protective coatings, easily extruded, and has high salvage value. Conventional extrusion techniques can produce the required shapes to substantial lengths.

The low density of aluminum alloy allows forming lightweight deck panels 10 with a solid surface and approximately 5 inches in depth, weighing approximately 18 lbs. per sq. ft. in plan, which approximately equals the depth and weight of steel grating decks. As noted above, reducing the dead load of the deck increases the live load capacity of the bridge. Decks that are as light as existing lightweight steel grating decks are required to replace those existing decks on moveable bridges without replacing the existing lift mechanism and counterweight system.

Figure 3:
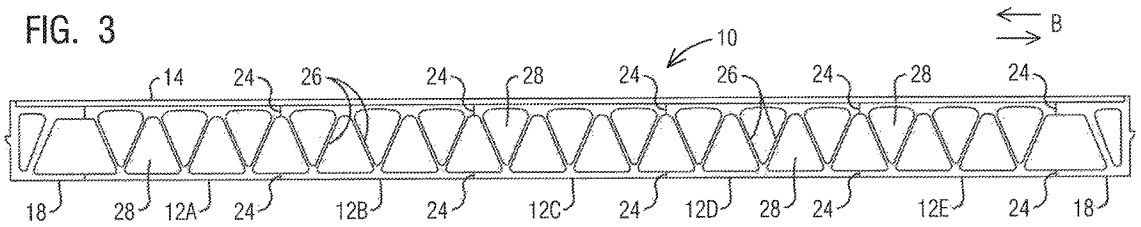
FIG. 3 is an end view of a bridge deck panel in accordance with aspects of the invention.
Figure 4:
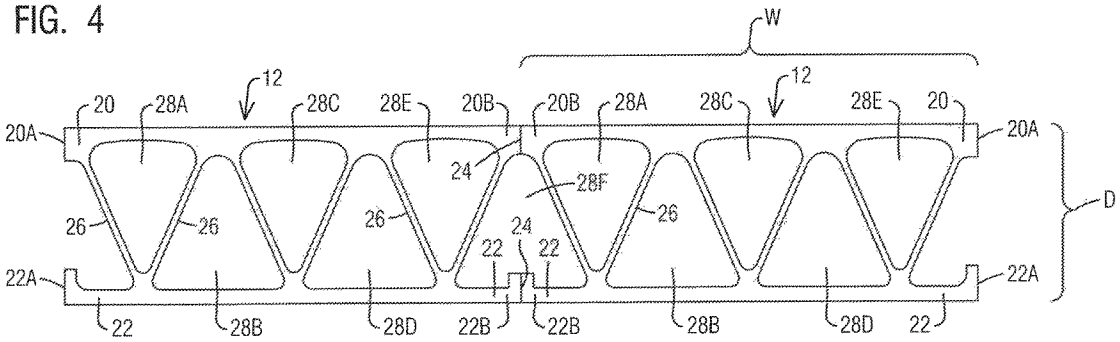
FIG. 4 is an end view of an embodiment including two extruded aluminum structural elements in accordance with aspects of the invention.

With respect to FIGS. 3 and 4 an end view of a deck panel 10 is shown including embodiments of the extruded aluminum structural elements 12, and an end view of an embodiment including two extruded aluminum structural elements 12. As shown in FIG. 3, the deck panel 10 includes five extruded aluminum structural elements 12A-12E. An end extrusion 18 is welded to each outer structural element 12A, 12E of the deck panel 10. Each extruded aluminum structural element 12A-12E includes a top flange 20 and a bottom flange 22 along each side thereof. Adjacent structural elements (e.g., 12A, 12B) are preferably longitudinally shop welded along top flanges 20 and bottom flanges 22. The welds 24 may be full penetration welds from a top surface to the bottom of the respective top flange 20 and bottom flange 22 of adjacent deck panels 10. Note, direction of travel over the deck panel is represented by arrows "B".

Friction-stir welding (FSW) is a preferred method of welding for fabrication of the deck panels 10. For example, arc welding, compared to FSW, makes it difficult to hold dimensional tolerances. Arc welding, compared to FSW, generates more heat, therefore, heat distortion of the aluminum makes it difficult to fabricate the panels within bridge tolerances for flatness, squareness, and straightness. The heat-affected zone of an arc weld is larger due to the heat required to bring the metal to a molten state. FSW only needs to bring the metal to a plastic state. The heat needed for arc welding results in a joint that is not as tough (Charpy impact test) as a weld made by FSW. Compared to arc welding, FSW produces tougher welds that are less expensive and allow the panel to be produced to tolerances required for bridges.

FSW may include dual self-reacting pin tools to simultaneously weld together the top and bottom flanges 20, 22 of adjacent structural elements 12 in which case a backing plate is not required. However, one-sided FSW may be used for welding. One or more backing plates (not shown) may be secured to the top and bottom flanges 20, 22 within the void 28F (FIG. 4) created at the junction of two adjacent structural elements 12. One-sided FSW may be simultaneously performed on the top and bottom flanges 20, 22 to form welds 24. Moreover, the above described structural elements 12, 12A-12E are not limited to the disclosed configuration. A prior art configuration for extruded aluminum elements (not previously used for bridges deck panels and structural elements) may include a vertical web at one or both sides of the element and notches and protrusions to interconnect adjacent structural elements may be incorporated. In such a configuration, one-sided FSW may be used to simultaneously weld the top and bottom flanges 20, 22 of adjacent structural elements 12, 12A-12E, and end extrusions 18.

In embodiments shown in FIGS. 3 and 4, the structural elements 12, 12A-12E, include a series of alternating inclined webs 26 disposed between and integrally formed with the top flange 20 and bottom flange 22. In the embodiment disclosed herein, the inclined webs 26 are configured in a manner such that voids 28A-28E are formed having a cross-sectional generally isosceles shape. In an embodiment, the structural elements 12, 12A-12E preferably have an odd number of voids 28, 28A-28E or at least three voids 28. As further shown, the outer voids 28A, 28E and middle void 28C are inverted isosceles triangles; and, the inner voids 28B, 28D are upright isosceles triangles.

Figure 5:
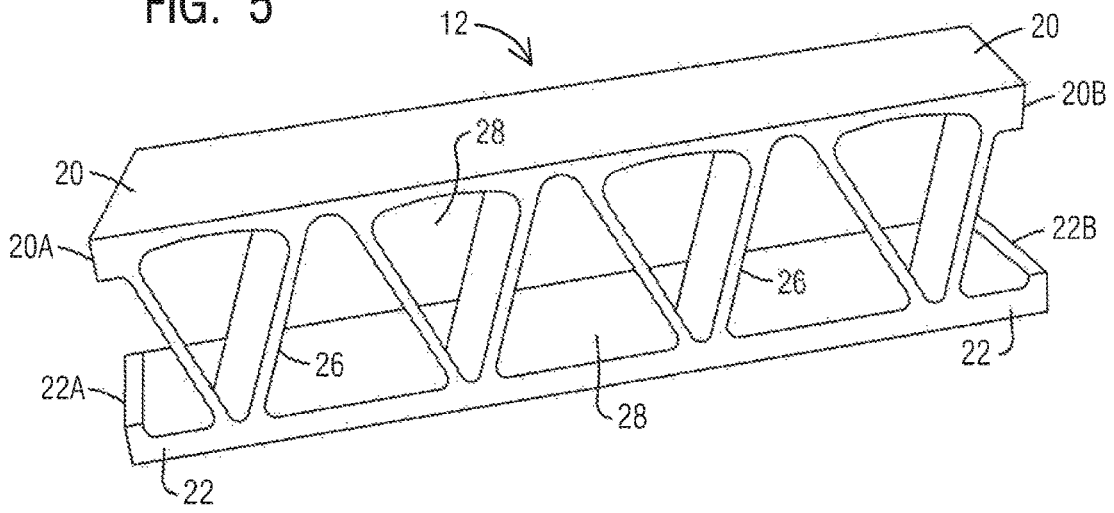
FIG. 5 is a perspective of an extruded aluminum structural element in accordance with aspects of the invention.

Regarding FIGS. 4 and 5, the respective ends 20A (first end of top flange 20), 20B (second end of top flange), 22A (first end of bottom flange), 22B (second end of bottom flange) have substantially the same thickness. By way of example, the thickness of the ends 20A, 20B, 22A, 22B may be about 0.6 inches. By having the thickness the same at the ends of the top and bottom flanges 20, 22, two adjacent structural elements 12 may be effectively friction-stir welded longitudinally along a weld site at the junction of top and bottom flanges 20, 22 of adjacent structural elements 12.

The overall depth of the bridge deck panel is chosen considering the depth of the deck being replaced (to minimize or avoid costs associated with adjusting the road way grade as it approaches the bridge), design loads, fatigue life, supporting stringer spacing, and deflection requirements. In an embodiment in which the deck panels 10 may be used to form a bridge deck to replace steel open-grid deck on a moveable bridge, such as a bascule bridge, or fixed span bridge which may have a bridge deck depth of about five inches, accordingly, the structural elements 12 may have a depth dimension "D" of about 5.0 inches from a top surface to a bottom surface of a structural element 12, and a width dimension "W" of about 13.5 inches. However, the invention is not limited to these dimensions, for example the structural elements 12 could be extruded to be 4.5 inches or 9 inches or 18 inches in width. In addition, some extrusion techniques and systems, may extrude structural elements 12 up to thirty-two feet long, which is generally the maximum width of the roadway of moveable bridges with steel open-grid deck.

Figure 6:
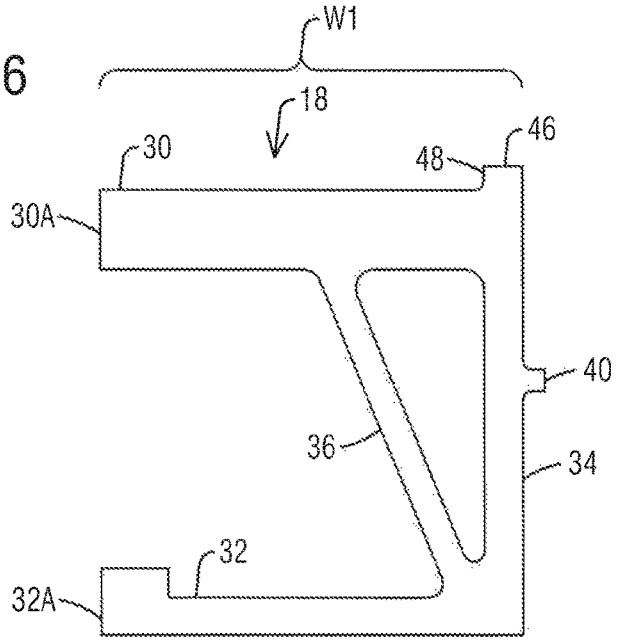
FIG. 6 is an end view of an end extrusion in accordance with aspects of the invention.

An end extrusion 18 is shown in more detail in FIG. 6. The end extrusion 18 is preferably an aluminum extruded element, and may include top flange 30 and bottom flange 32 interconnected by a vertically disposed web 34 and an inclined web 36. The top flange 20 and bottom flange 32 are longitudinally shop friction-stir welded to corresponding top and bottom flanges 20, 22 of a structural element 12 of a deck panel 10. The end extrusion 18 has a length that is substantially equal to a length of the structural elements 12 wherein each structural element 12 has the same length. The respective ends 30A, 32A of the top flange 30 and bottom 32 preferably have the same thickness of 0.6 inches.

The end extrusions 18 are also preferably about 5.0 inches in depth from a top surface to a bottom surface. In addition, the end extrusion 18 may have a width dimension "W1" of about 5.25 inches, but the width could be more or less. For example, the width dimension may be about 3 inches. That is, the width dimension "W2" may be adjusted as necessary to meet bridge deck specifications, by adjusting the aluminum extrusions or trimming the top and bottom flanges 30, 32. In addition, the width dimension could be as much as 9¾ inches or more, depending on the dimensions of a bridge deck system to be replaced and the width of the structural elements 12, 12A-12E.

The deck panel 10 shown in FIG. 3, includes five of the extruded aluminum structural elements 12, but the deck panel 10 could include more or fewer. Given the above examples of dimensions of the structural elements 12 and end extrusions 18, a deck panel 10 having six structural elements 12 for example may be about 7.5 feet wide; however, the number of structural elements 12 used to fabricate a deck panel 10 may vary. Accordingly, the width of a deck panel 10 may vary.

Figure 7:
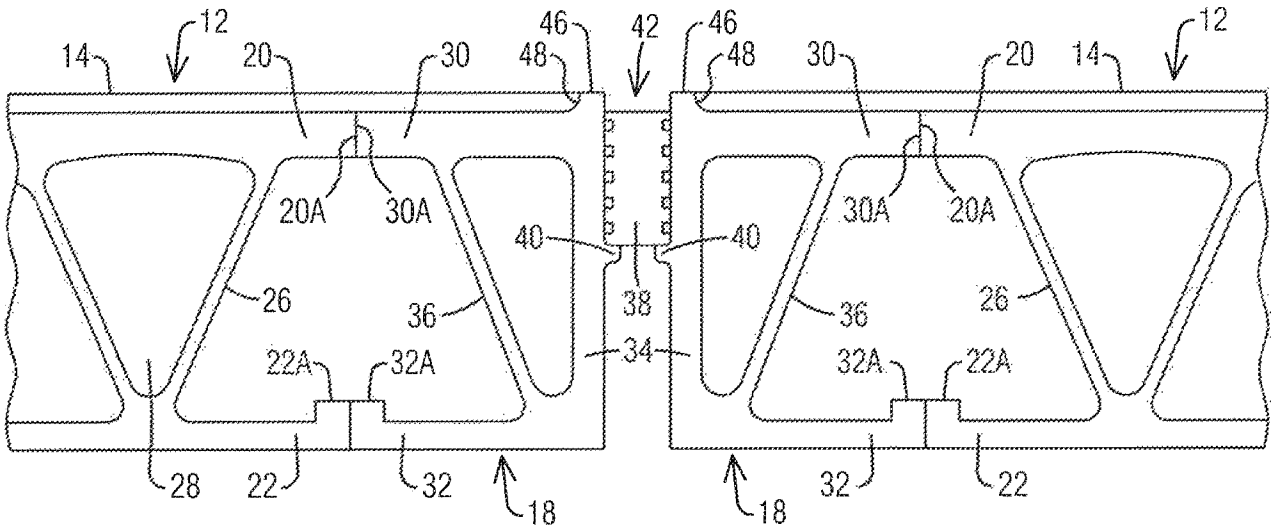
FIG. 7 is a partial end view of an expansion joint between two bridge deck panels in accordance with aspects of the invention.

The end extrusion 18 may serve a couple of functions which is to stiffen the ends of the panel and close off the sides of the deck panel 10 to prevent debris from accumulating along the sides of the deck panel 10. The end extrusion 18 is also configured in a manner that when deck panels 10 are positioned side-by-side a void 42 is formed for installation of an expansion joint 38 to secure together two adjacent deck panels 10. As shown in FIGS. 6 and 7, the end extrusions 18 include an elongated first protrusion 40 disposed on the vertical web 34. When deck panels 10 are positioned side-by-side the first protrusions 40 and vertical plates 34 form a void 42 in which an expansion joint seal 38 is fitted to close the space between two adjacent deck panels 10. The protrusions 40 form a stop for the expansion joint seal 38.

As further shown in FIGS. 6 and 7, the end extrusions 18 may include a second protrusion 46 along a top end of the vertical web 34 or at an end of the top flange 30. The second protrusion 46 forms a lip 48 creating a dam to contain the wearing layer 14 as it is applied to a top surface of the deck panel 10. The second protrusion 46 protects an edge of the wearing layer 14 from damage as the deck panels 10 are handled during fabrication, installation or as traffic may travel over the bridge deck. The second protrusion 46 on the top flanges 30 may be about 0.25 inches in height as measured from a top surface of the top flange 30, and width dimension of about 0.50 inches.

Figure 8:
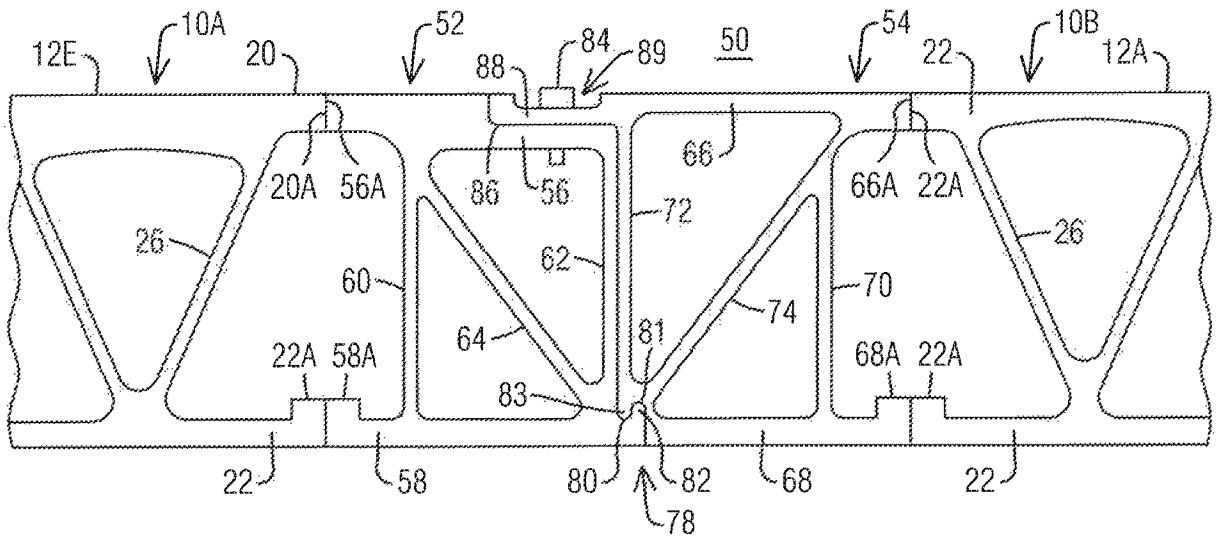
FIG. 8 is a partial end view of a splice joint between two bridge deck panels in accordance with aspects of the invention.

In yet another embodiment, a splice joint 50 may be incorporated in a bridge deck to secure together adjacent bridge deck panels 10. As shown in FIG. 8 , the splice joint 50 may include a first extruded aluminum element 52 and a second extruded aluminum element 54. The first element 52 includes a top flange 56 with flange end 56A and a bottom flange 58, with flange end 58A, interconnected by a first vertical web 60, a second vertical web 62 spaced apart from the first vertical web 60 and an inclined web 64. Similarly, the second extruded element 54 includes a top flange 66 and a bottom flange 68 interconnected by a first vertical web 70, a second vertical web 72 spaced apart from the first vertical web 72 and an inclined web 74.

As shown the first element 52 and second element 54 include a tongue and groove arrangement 78 at bottom corners of the respective elements 52, 54. Each of the elements 52, 54 includes an elongated groove 80, 81 and elongated tongues 82, 83 each of which preferably extend the length of the elements 52, 54. The elements 52, 54 are the same length of the extruded aluminum structural elements 12.

As further shown, a fastener 84 interconnects the top flanges 56, 66 of the first and second 52, 54 respectively. More specifically, the top flange 56 of the first element 52 includes a recessed portion 86 that extends the length of the first element 52. The top flange 66 of the second element 54 includes an extension 88 that seats in the recessed portion 86. The recessed portion 84 extends the entire length of the first element 52, and the extension 84 extends the entire length of the second element 54.

The first element 52 is preferably longitudinally shop-welded to an extruded aluminum structural element 12E of a first deck panel 10A and the second element 54 is longitudinally welded to a structural element 12A of a second deck panel 10B. The first and second splice elements 52, 54 are then interconnected as shown in FIG. 8, and fasteners 84, such as bolts passed through the extension 88 and recessed portion 86 secure together the splice elements 52, 54 and adjacent deck panels 10A, 10B. As further shown, the extension 88 has an elongated detent 89 that extends the length of the extruded element 54, so the heads of the fasteners 84 extend above the top surface of the deck panels 10.

Figure 9:
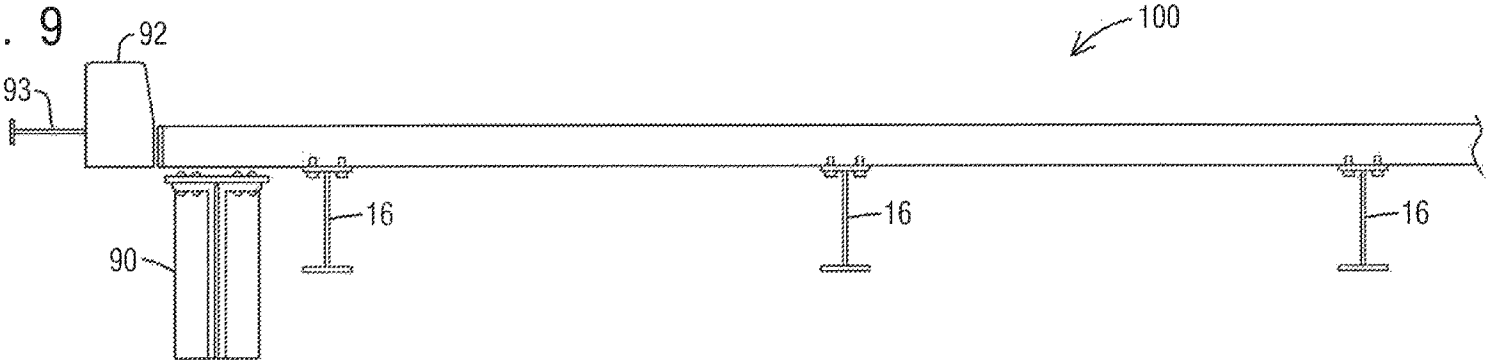
FIG. 9 is a partial sectional view of a bridge deck with shop or field mounted stringers in accordance with aspects of the invention.

With respect to FIG. 9, a sectional view of a deck panel 10 or bridge deck is illustrated over a bridge girder 90, and adjacent a curb 92 and sidewalk 93 that are supported by a bridge superstructure (not shown). As indicated above, the stringer beams 16 are mounted or bolted to the bottom of the deck panels 10 in the direction of traffic over the bridge deck panels 10. The stringer beams 16 are preferably shop mounted but can also be field mounted to the bridge deck panels 10.

The stringer beams 16 may be spaced apart according to a bridge superstructure that may or may not include floor beams. Most moveable bridges, such as bascule bridges, have floor beams that are spaced apart with stringer beams 16 that span between and are mounted to the floor beams. For 5-inch deep deck panels 10, stringer beams 16 can be mounted up to 6.0 feet apart and still provide sufficient structural support to meet bridge design requirements. If the stringer beams are spaced apart 6.0 feet the deck panels 10 should have a deflection rating L/800, where L is the stringer beam spacing. Structural elements are governed by AASHTO LRFD Bridge Design Specifications, 7th Edition.

Figure 10:
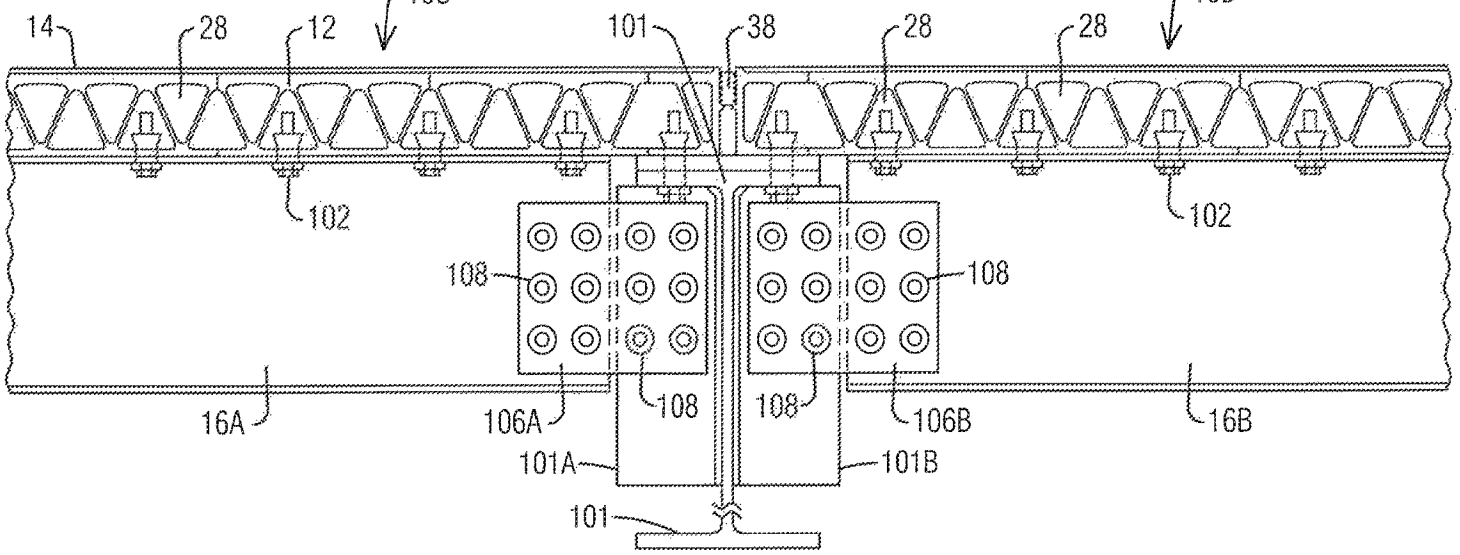
FIG. 10 is a partial sectional view of two bridge deck panels of a bridge deck and stringers mounted to floor beams of a bridge superstructure.

A schematic of bridge deck panels 10C, 10D fixed to floor beams 101 is shown in FIG. 10. Stringer beams 16A, 16B are mounted to the bottom of bridge deck panels 10C, 10D respectively, using fasteners 102, such as bolts. Because, the head or shaft of a fastener will be disposed in a void 28 of a structural element 12, blind-type fasteners or expansion bolts may be used to shop or field mount the stringer beams 16A, 16B to the bottom of deck panels 10C, 10D. Conventional structural bolts, such as ASTM A325 heavy-hex or tension control bolts, may also be used to shop or field mount the stringer beams 16A, 16B to the bottom of the deck panels 10C, 10D. Conventional bolts require custom tools to deliver and install the tension control bolts or heavy-hex nuts and washers along the void 28 to the location of the holes and to hold the fastener components during tightening. As indicated above, the stringer beams 16A, 16B are preferably shop mounted to the deck panels 10C, 10D to eliminate field work and labor, which can be expensive, but can also be field mounted to facilitate shipping to the bridge location. In addition, fasteners 108 are installed to mount the stringer beams 16A, 16B to floor beam connection tees 101A, 101B which are components of the floor beam 101. Mounting plates 106A, 106B, and fasteners 108 secure the stringers 16A, 16B to the floor beam connection tees 100A, 100B respectively.

The application of the wearing layer is now described, and may be applied over a period of a couple or several days. For example, on a first day a shop space in which the wearing layer will be applied to a deck panel 10, will be prepped by washing the space and isolating the space using plastic curtains to prevent exposing any solutions, the wearing layer materials, and deck panel to contaminants. In order to provide a good bonding between the deck panel top surface and the wearing layer, all welds and top surface area of a deck panel 10 are buffed with a low speed buffer to remove all oxide, scuff marks, and weld splatters. Care should be taken to avoid scratches or gouges to the aluminum top surface that exceed a maximum depth of 1/32".

The deck panel is then power washed using a solution of heated water and a metal cleaner such as Ardrox 6440-LF. The deck panel is then rinsed with pressurized tap water until all soap is removed. The deck panel is then inspected to ensure all areas have been properly cleaned. Any areas that are not fully cleaned will be spot cleaned using above described solution and non-scratch scouring pads such as Scotch Brite® pads. The deck panel 10 is then left to dry.

On a second day, using a paint roller the top surface of the deck panel 10 is treated with a pretreatment solution, preferably a chrome-free solution such as Chemetall Permatreat®, ensuring a level application across the surface. The solution is then allowed to air dry. On a third day, a first layer of a wearing layer is applied, and time is allowed for it to set. Then, a second layer or third is applied and allowed to set until cured. The wearing layer may consist of a two part epoxy with a granulated aggregate, such silica, flint or basalt for example. Such a wearing layer for example may be the Flexolith brand that may be obtained from Euclid Chemical located in Cleveland, Ohio. Either before the application of the pretreatment solution or before application of the wearing layer, stops or damns may be clamped to edges or ends of the deck panel 10 that do not include the end extrusions 18 to control application of the pretreatment solution and the wearing layer.

A bridge deck constructed from the above described deck panels 10, 10A-10D, including the plurality of approximately 5-inch deep aluminum extruded elements 12, 12A-12E, and end extrusions 18, that are longitudinally shop welded (preferably friction-stir welded) provide a weight-neutral (18 psf to 21 psf) solution for replacing approximately 5-inch deep steel open-grid bridge decks for moveable bridges such as bascule bridges. The deck panels 10, 10A-10D provide corrosion resistance and improved strength and fatigue resistance. With the spacing of stringer beams 16 limited to a spacing of 6.0 feet, the bridge deck live load deflection will meet the AASHTO LRFD Bridge Design Specifications, $7^{th}$ Edition, which limits deflection to L/800, where L equals the stringer beam spacing. Moreover, the deck panels 10, 10A-10B are adaptable to different moveable bridge configurations, and minimal bridge modifications would be required for bridge deck installation.

With respect to FIGS. 11-14, an embodiment of the invention includes a bridge deck panel having one or more male extruded aluminum structural elements 312, one or more female extruded aluminum structural elements 412, and one or more end extrusions 518. The structural elements 312, 412, are multi-void including voids 328, 428 between consecutive inclined plates or webs 326, 426 or between an inclined web 326, 426 and a vertical web 321, 421.

Figure 11:
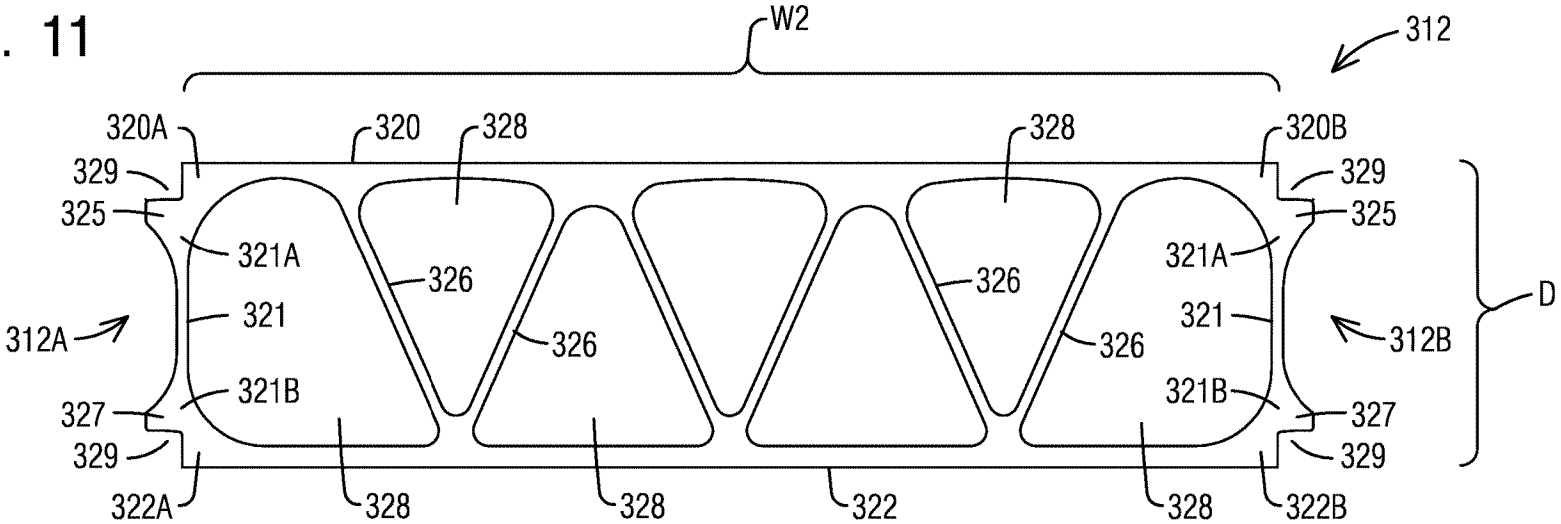
FIG. 11 is an end view of a male extruded aluminum structural element in accordance with aspects of an embodiment of the invention.

With respect to FIG. 11, the male structural element 312 includes a top flange 320 and bottom flange 322, and vertical webs 321 disposed there between at each ends 320A, 322A and 320B, 322B of the flanges 320, 322. In addition, an upper protrusion 325 and lower protrusion 327 are provided toward respective ends 321A, 321B of the vertical members 321, thereby forming re-entrant corners 329 between the ends 320A, 322A and 320B, 322B of the top flange 320 and bottom flange 322 and the protrusions 325, 327. These protrusions 325, 327 extend the length of the structural element 312 and on each side thereof. As shown, the vertical webs 321 are on both a first side 312A and second side 312B of the structural element 312. As explained in more detail below the re-entrant corners 329 are configured to receive tabs from an adjacent female extruded structural element 412 or a tab of an end extrusion 518.

The dimensions of the components of the male structural element 312 may vary according to structural demands associated with a deck panel 10 and bridge. By way of example, the element 312 may have a width "W2" from the first flange end 320A to the second flange end 320B of about 18 inches±0.11 inches. The structural element may have a depth dimension of about five inches and preferably about 5.030 inches. In addition, the protrusion 325, 327 are each about 0.600 inches wide from a surface of the respective flange ends 320A, 320B, 322A, 322B. The protrusions 325 may be spaced below a top surface of top flange ends 320A, 320B about 0.620 inches; and protrusions 327 are spaced from the bottom surface of the bottom flange ends 322A, 322B about 0.610 inches.

Figure 12:
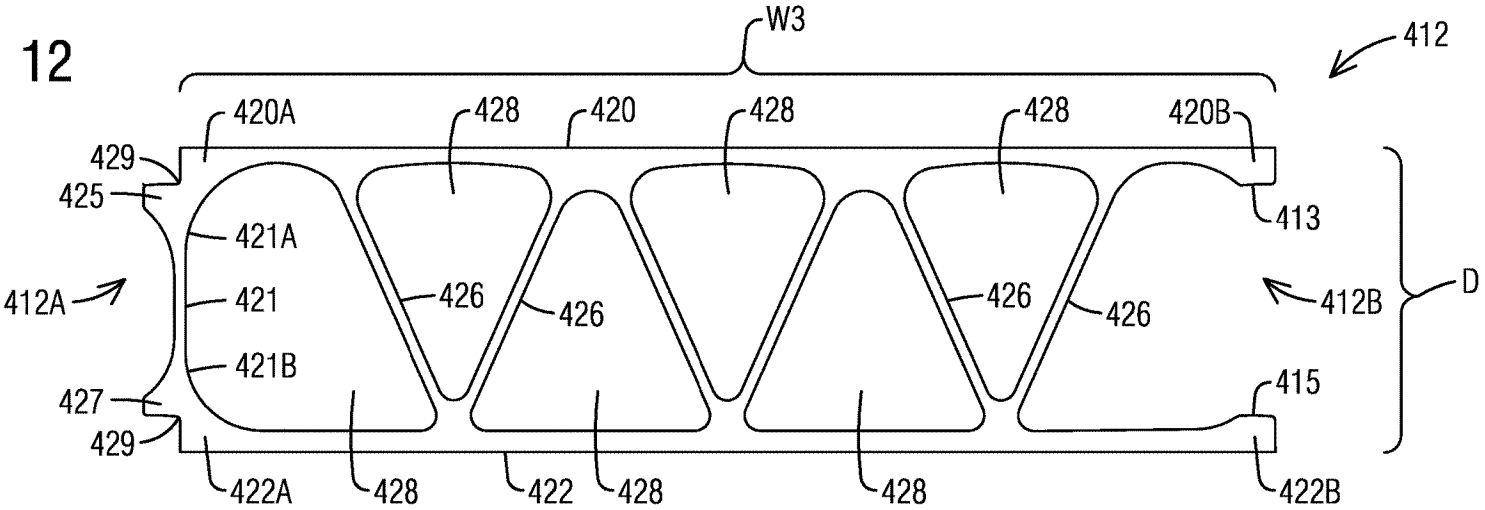
FIG. 12 is an end of a female extruded aluminum structural element in accordance with aspects of an embodiment of the invention.

In reference to FIG. 12 the female extruded aluminum structural element 412 is illustrated and includes a top flange 420 and bottom flange 422 interconnected by inclined spaced apart plates or webs 426 and an end vertical web 421 to form voids 428. The vertical web 421 is disposed along a first side 412A of the structural element 412. An upper protrusion 425 and lower protrusion 427 are provided at the first end 412A at the vertical member 421, thereby forming re-entrant corners 429 at the first side 412A These protrusions 425, 427 extend the length of the structural element 412. As explained in more detail below, the re-entrant corners 429 are configured to receive tabs from an adjacent female extruded structural element 412.

As further shown, the second side 412B is open and does not include a vertical web whereby the flange ends 420B, 422B include tabs 413, 415, respectively, configured to fit in re-entrant corners of an adjacent male extruded aluminum structural element to form a deck panel.

The dimensions of the components of the female structural element 412 may vary according to structural demands associated with a deck panel 10 and bridge, and its dimensions correspond to that of the male structural element 312. The element 412 may have a width "W3" from the first flange end 420A to the second flange end 420B of about 18 inches±0.11 inches. The structural element may have a depth dimension of about five inches and preferably about 5.030 inches. In addition, the protrusions 425, 427 are each about 0.600 inches wide from a surface of the respective flange ends 420A, 422A. The protrusion 425 may be spaced below a top surface of top flange ends 420A about 0.620 inches; and protrusion 427 is spaced from the bottom surface of the bottom flange ends 422A about 0.610 inches.

Figure 13:
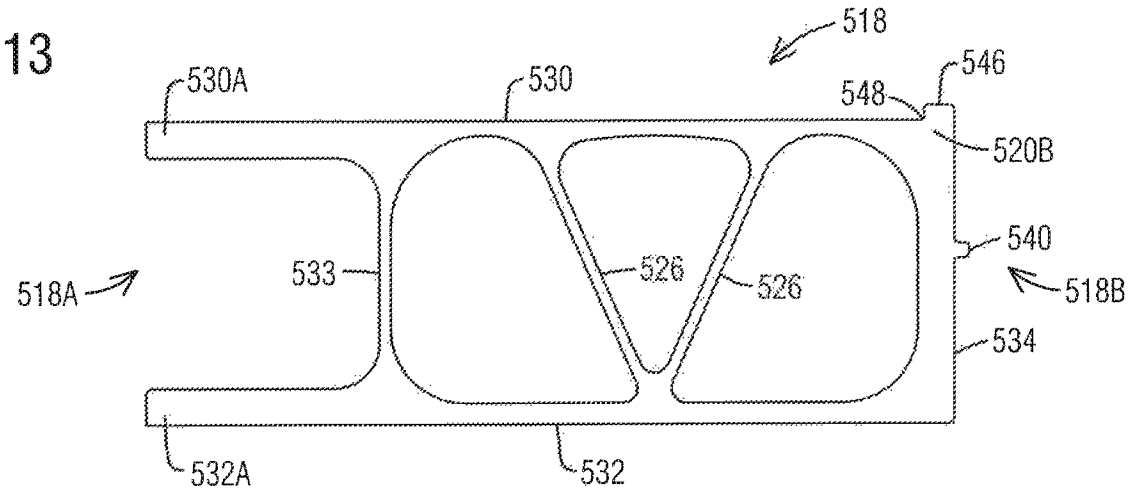
FIG. 13 is an end view of an end extrusion aluminum structural element in accordance with aspects of an embodiment of the invention.

With respect to FIG. 13, an end extrusion 518 is shown and functions similar to the above-described end extrusion 18. More specifically, the end extrusion 518 includes a top flange 530 and a bottom flange 532, the lengths of which can be trimmed to adjust a width of the end extrusion 518 in accordance with width or length of a deck panel. The end extrusion 518 includes inclined webs 526 between a first vertical web 533 along a first side 518A of the end extrusion 518 and a second vertical web 534 along a second side 518B of the end extrusion 518.

The end extrusion 518 may serve a couple of functions which is to stiffen the end of the deck panel 10 and to close off the sides of the deck panel 10 to prevent debris from accumulating along the sides of the deck panel 10. The end extrusion 518 is also configured in a manner that when deck panels 10 are positioned side-by-side a void is formed for installation of an expansion joint seal to close the space between two adjacent deck panels 10. The end extrusions 518 include an elongated first protrusion 540 disposed on the vertical web 534. When deck panels 10 are positioned side-by-side, the first protrusions 540 and vertical plates 534 form a void in which an expansion joint seal is fitted, as shown in FIG. 7, to close the space between two adjacent deck panels 10. The protrusions 540 form a stop for the expansion joint seal.

As further shown in FIG. 13, the end extrusion 518 may include a second protrusion 546 along a top end of the vertical web 534 or at an end of the top flange 520. The second protrusion 546 forms a lip 548 creating a dam to contain the wearing layer 14 (FIGS. 2 and 3) as it is applied to a top surface of the deck panel 10. The second protrusion 546 protects an edge of the wearing layer 14 from damage as the deck panels 10 are handled during fabrication, installation or as traffic may travel over the bridge deck. The second protrusion 546 on the top flanges may be about 0.25 inches in height as measured from a top surface of the top flange 520, and width dimension of about 0.50 inches. The width of the end extrusion 518 may vary according to the dimensions of the deck panel 410 as required for a bridge, but typically the width may be about 13.5 inches. The top flange 530 and bottom flange 532 of end extrusion 518 may be trimmed an equal amount from ends 530A, 532A, respectively, to adjust the width of the end extrusion 518. The top flange 530 and bottom flange 532 are typically trimmed a maximum length of 2.25 inches, which typically provides a range in width for the end extrusion 518 from 13.5 inches to 11.25 inches.

Figure 14:
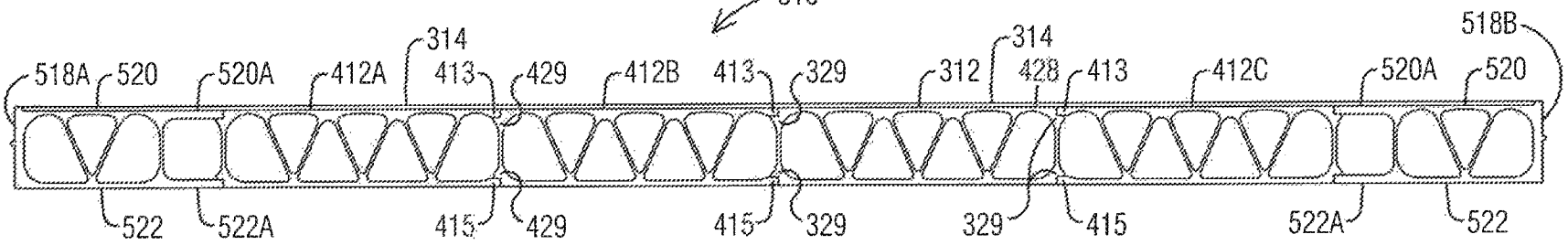
FIG. 14 is an end view of a bridge deck panel incorporating the structural elements of FIGS. 11-13.

With respect to FIG. 14, an end view of a deck panel 310 is shown including extruded aluminum structural elements 312, 412 and 518. In this example, the deck panel 310 includes two end extrusions, a first end extrusion 518A and a second end extrusion 518B each having flange ends 520A, 522A disposed in mating relationship with the re-entrant corners 429 of a first female structural element 412A and 429 of third female structural element 412C. In addition, the tabs 413, 415 of the first female structural element 412A are joined to the second structural element 412B at re-entrant corners 429; and, the tabs 413, 415 of the second female structural element 412B and third female structural element 412C are joined to the male structural element 312 at re-entrant corners 329.

In this embodiment only a single male structural element 312 is incorporated into the deck panel 310 in order to link a second female structural element 412B to a third female structural element 412C which is connected to the second end extrusion 518B to complete the deck panel 310. As shown, the deck panel includes three female structural elements including the first female structural element 412A that is joined to the first end extrusion 518A, the second female structural element 412B that is joined to the first female structural element 412A at one end and to the male structural element 312 at the other end. The male structural element 312 is connected to the third female structural element 412C which at its opposite end is connected to the second end extrusion 518B.

The structural elements 518A, 518B, 412A, 412B, 412C, 312 may be fastened together to one another using single-sided friction-stir welding, wherein the weld is a full-penetration weld at the interface between a re-entrant corner and tab and flange end. The full-penetration welds are preferably "through" welds that extend from top surfaces to bottom surfaces of interfacing components of adjacent structural elements. The welding is preferably performed "in-shop" so that deck panels are prefabricated before taken to a site for installation, and installed to replace a bridge deck as described. While friction-stir welding is preferred for fabrication of deck panels, other welding techniques, such as arc welding may be used to fabricate a deck panel. To that end, mechanical fasteners or fastening systems may be used to fabricate deck panels.

Figure 1:
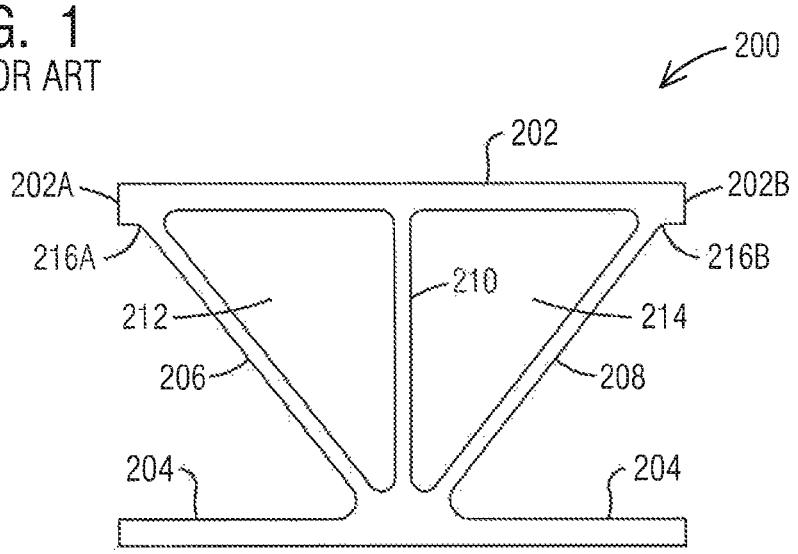
FIG. 1 PRIOR ART
FIG. 1 is an end view of a prior art extruded aluminum structural element for a bridge deck panel.

As also shown in FIG. 14, the deck panel 310 includes a wearing layer 314, which may be applied as described above. In addition, the deck panel 310 may include stringer beams 16 that are fastened to undersides of the structural elements 312, 412, 518 as described above with reference to FIGS. 1, 9 and 10. The deck panel 310 may also be mounted to a bridge superstructure as described above with reference to FIG. 10. While the embodiments of the deck panels described here are shown with the extruded aluminum extruded elements are positioned transversely relative to a direction of travel over a bridge, the invention is not so limited and may include embodiments in which the structural elements run longitudinally relative to the direction of traffic over a bridge, in which case stringer beams may or may not be necessary.

In addition to the foregoing, the bottom surface of deck panel 10 may be treated to meet standards associated with fire resistance. For example, a fire resistant coating may be applied to a bottom surface of deck panel 10. One such coating is FIREFREE® 88 sold by Firefree Coatings, Inc. Another example is to provide an oxide coating using microarc oxidation (MAO).

While certain embodiments of the present invention have been shown and described herein, such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A modular bridge deck system supported on a plurality of cooperating girders, comprising:

a plurality of deck panels secured together to form a modular bridge deck wherein each deck panel being formed by longitudinally shop friction-stir welding a plurality of elongated, multi-void, extruded aluminum structural elements, and a top surface of the respective deck panels and the longitudinal shop-welding form a substantially continuous top surface of the modular bridge deck; and, wherein each of the aluminum structural elements are the same length and each deck panel has at least one extruded aluminum structural end element comprising:

a top flange longitudinally shop friction stir welded to a corresponding top flange of an outer extruded aluminum structural element of a deck panel;

a bottom flange longitudinally shop-welded to a corresponding bottom flange of the outer extruded aluminum structural element of the deck panel;

a vertically disposed webs integrally formed with the top flange and bottom flange; and, wherein the aluminum structural end element, including the top flange, bottom flange and web, has a length that is equal to a length of each aluminum structural element.

2. The modular bridge deck system of claim 1, wherein each structural end element includes an elongated protrusion along an outer surface of the web, wherein the protrusion of one deck panel faces the protrusion of another structural end element of an adjacent deck panel forming an elongated void between the adjacent deck panels.

3. The modular bridge deck of claim 2, further comprising a plurality of expansion joints wherein each expansion joint is disposed at a respective elongated void between adjacent deck panels.

4. A modular bridge deck system supported on a plurality of cooperating girders, comprising:

a plurality of deck panels secured together to form a modular bridge deck wherein each deck panel being formed by securing together a plurality of elongated, multi-void, extruded aluminum structural elements, and a top surface of the respective deck panels is a substantially continuous top surface of the modular bridge deck;

wherein each deck panel includes a plurality of first structural elements each first structural elements having a top flange and a bottom flange parallel to one another, a first side and a second side, and a vertical web integrally formed with and disposed between the top flange and the bottom flange at the first side, an upper tab on the top flange at an end thereof at the second side and a lower tab on the bottom flange at an end thereof at the second side, wherein the upper tab and lower tab are spaced apart and aligned relative to one another; and, wherein each first structural element includes at the first side an upper protrusion below an end of the top flange and extending a length of the first structural element to form an upper re-entrant corner between the top flange end and the upper protrusion, and the first structural element further includes at the first side a lower protrusion above an end of the bottom flange and extending a length of the first structural element to form a lower re-entrant corner between the bottom flange end and the lower protrusion at the first side;

one or more second structural elements that are end structural elements having a first side, a second side, a top flange and a bottom flange parallel to the top flange, a vertical web interconnecting second ends of the top flange and bottom flange at the second side and one or more inclined webs between the vertical member and first ends of the top flange bottom flange at the first side are configured to seat in the upper and lower re-entrant corners at the second end of the first structural element.

5. The modular bridge deck system of claim 4 further comprising one or more third structural elements having a first side, a second side, a top flange with a bottom flange parallel to the top flange, a first vertical web integrally connected with the top flange and bottom flange at the first side of the third structural element and a vertical web integrally connected with the top flange and bottom flange at the second side of the third structural element;

wherein each third structural element includes at the first side and at the second side an upper protrusion below an end of the top flange and extending a length of the third structural element on both the first and second sides to form an upper re-entrant corner between the top flange end and the upper protrusion at both the first sides and the second sides, and the third structural element further includes at the first side and second side a lower protrusion above an end of the bottom flange and extending a length of the third structural element at both the first side and second side to form a lower re-entrant corner between the bottom flange end and the lower protrusion at the first side and second side; and, wherein the re-entrant corners at the side of the third structural element are configured to receive the tabs on the first side of the first structural element.

* * * * *